US005746577A

United States Patent [19]

Ito et al.

[11] Patent Number: 5,746,577

[45] Date of Patent: May 5, 1998

[54] CENTRIFUGAL-TYPE BLOWER

[75] Inventors: Koji Ito, Nagoya; Teruhiko Kameoka, Okazaki; Kouji Matsunaga, Kariya; Kazutoshi Kuwayama, Nakashima-gun, all of Japan

[73] Assignee: Denso Corporation, Kariya, Japan

[21] Appl. No.: 797,728

[22] Filed: Feb. 11, 1997

[30] Foreign Application Priority Data

Feb. 14, 1996 [JP] Japan ..... 8-027031

[51] Int. Cl.[6] ..... F04D 29/38

[52] U.S. Cl. ..... 416/178; 416/187

[58] Field of Search ..... 415/206; 416/178, 416/187

[56] References Cited

FOREIGN PATENT DOCUMENTS

| | | | |
|---|---|---|---|
| 2407613 | 9/1974 | Germany | 416/178 |
| 67009 | 6/1977 | Japan | 416/178 |
| 194196 | 8/1991 | Japan | 416/178 |
| A-6-255341 | 9/1994 | Japan . | |
| 274301 | 9/1970 | U.S.S.R. | 416/178 |

*Primary Examiner*—John T. Kwon

*Attorney, Agent, or Firm*—Harness, Dickey & Pierce, PLC

[57] ABSTRACT

An inner diameter ($d_2$) of a centrifugal-type multiple-vane fan at a side where the motor is inserted (i.e., the insertion side) is larger than an inner diameter ($d_1$) of the centrifugal-type multiple-vane fan at a side where the motor is not inserted (i.e., the non-insertion side), such that the ratio of a difference between an outer diameter (D) and the inner diameter ($d_2$) of the centrifugal-type multiple-vane fan of the insertion side to a difference between the outer diameter (D) and the inner diameter ($d_1$) of the centrifugal-type multiple-vane fan of the non-insertion side is in a range of 0.6–0.95. Thus, a centrifugal-type blower having the centrifugal-type multiple-vane fan can obtain a desired air volume while maintaining a small size of the centrifugal-type blower.

9 Claims, 4 Drawing Sheets

CENTRIFUGAL-TYPE BLOWER

CROSS-REFERENCE TO RELATED APPLICATION

This application is related to and claims priority from Japanese Patent Application No. Hei. 8-27031 filed on Feb. 14, 1996, the contents of which are hereby incorporated by reference.

BACKGROUND OF THE INVENTION

1. Field of the Invention

The present invention relates to a centrifugal-type blower which uses a centrifugal-type multiple-vane fan and is suitably applied to an air conditioning apparatus for a vehicle.

2. Description of Related Art

As well known, a centrifugal-type blower includes a centrifugal-type multiple-vane fan for sucking air in the axial direction of the rotary shaft and for blowing air radially outwardly, a motor for driving the fan, and a scroll casing for accommodating the centrifugal-type multiple-vane fan and the motor and for forming an air passage.

In the centrifugal-type blower, to increase a volume of blown-air while maintaining a constant rotational speed of the centrifugal-type multiple-vane fan, it is necessary for an air suction area (i.e., an inner diameter area of the centrifugal-type multiple-vane fan) to be increased so as to decrease a pressure loss at the time of sucking air. However, when an inner diameter of the centrifugal-type multiple-vane fan is simply made larger to increase the suction area, an outer diameter of the centrifugal-type multiple-vane fan becomes large so that the size of the centrifugal-type blower becomes large.

As a method for downsizing the centrifugal-type blower while increasing an air volume of the centrifugal-type blower, there has been conventionally known that, as shown in FIG. 8, the suction area is increased by means of sucking air from two end sides in the axial direction of the rotary shaft of the centrifugal-type multiple-vane fan in which the inner and outer diameters are respectively equal throughout the whole length in the axial direction of the rotary shaft of the fan. Further, a motor body portion 6*a* of the drive motor 6 is inserted into the centrifugal-type multiple-vane fan 1 to decrease the size in the axial direction of the rotary shaft of the centrifugal-type blower.

Here, the inner diameter of the centrifugal-type multiple-vane fan 1 is a dimension between the radial inner side end portions of the centrifugal-type multiple-vane fan (i.e., a diameter "$d_1$" in FIG. 8), and the outer diameter thereof is a dimension between the radial outer side end portions of the centrifugal-type multiple-vane fan (i.e., a diameter "D" in FIG. 8).

Although the inventors have experimentally produced and examined various types of the centrifugal-type blower, a desired air volume cannot be obtained while maintaining a small sized centrifugal-type blower. That is, at a side of inserting the drive motor 6, the motor body portion 6*a* constitutes a suction resistance so that the desired suction air volume cannot be obtained.

SUMMARY OF THE INVENTION

In view of the foregoing problems, it is an object of the present invention to suppress a decrease of air volume while maintaining a small size of the centrifugal-type blower.

According to the present invention, a motor body portion is inserted into a centrifugal-type multiple-vane fan from one end of the fan in the axial direction and supported in one end side, and an outer diameter of the fan is uniform throughout the whole length in the axial direction, and an inner diameter of the fan at one end is greater than an inner diameter of the fan at the other end. In this way, the volume of the blown-air can be increased while maintaining a small size of the fan. Thus, when compared with the blower in which the inner and outer diameters are respectively uniform throughout the entire length of the rotation shaft direction of the fan, a suction area at one end side substantially becomes larger, the suction resistance becomes smaller, and volume of the blown-air can be increased.

Further, it is preferable for a ratio of a difference between the outer diameter and the inner diameter of the fan at said one end to a difference between the outer diameter and the inner diameter of the fan at the other end to be in a range of 0.6–0.95.

Still further, there may be provided a boss plate for connecting the plurality of vanes and transmitting a driving force generated by said motor to the plurality of vanes, and a fan height between the one end of the fan and the boss plate is preferably smaller than a fan height between the other end of the fan and said boss plate.

Further, a ratio of the fan height between the one end and the boss plate to the fan height between the other end and the boss plate may be approximately equal to a ratio of a difference between the square of the inner diameter of the one end and the square of an outer diameter of the motor body portion to the square of the inner diameter of the other end.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Preferred embodiments of the present invention are described hereinafter with reference to the accompanying drawings.

A first embodiment of the present invention will be described. In the first embodiment, a centrifugal-type blower (hereinafter referred to as a blower) according to present invention is applied to an air conditioning apparatus for a vehicle.

Figure 1:
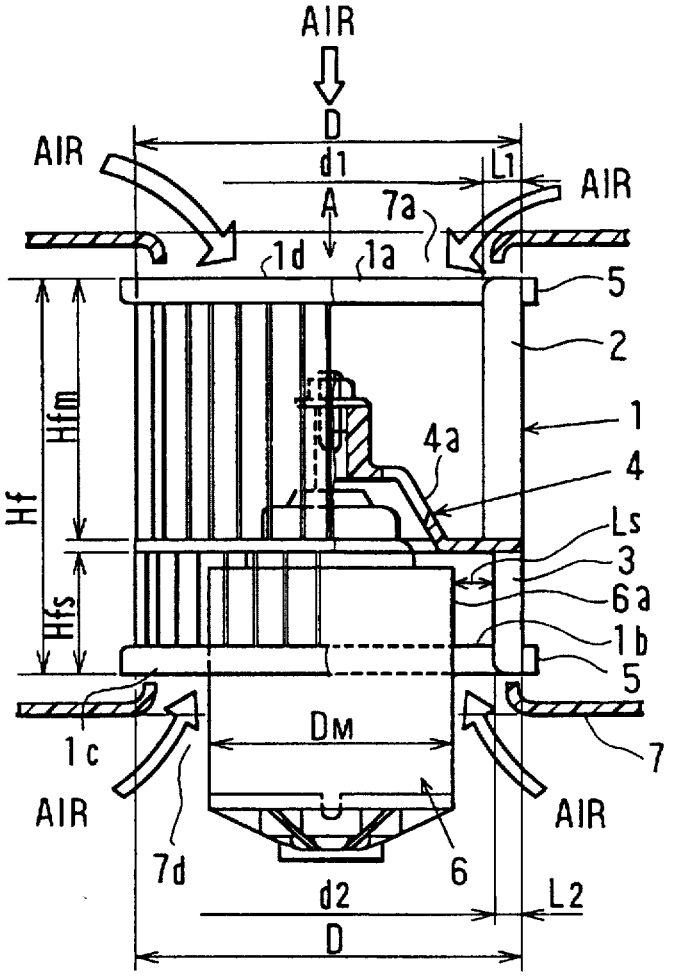
FIG. 1 is a cross-sectional view showing a centrifugal-type blower according to a first embodiment of the present invention.

FIG. 1 is a cross sectional view of the blower along an axial direction thereof in this embodiment. As shown in FIG. 1, a centrifugal-type multiple-vane fan 1 (hereinafter referred to as a fan) has a plurality of vanes (i.e., blades) 2 and 3 disposed circumferentially in such a manner that each longitudinal direction of the vanes 2 and 3 corresponds to an axial direction of the rotary shaft of the fan 1. The vanes 2 and 3 are connected and fixed to a boss plate 4 formed between both ends in the axial direction of the fan 1 and to rings 5 disposed at both end sides in the axial direction, and are rotated by a drive motor 6 through the boss plate 4.

A plurality of holes 4*a* are formed on the boss plate 4 to penetrate through the boss plate 4 from a side where a motor body portion 6*a* of the drive motor 6 is not inserted (hereinafter referred to as the non-insertion side) to a side where the motor body portion 6*a* is inserted (hereinafter referred to as the insertion side).

The fan 1 sucks air from both end sides in the axial direction and blows the air radially outwardly, and opening portions 1*a* and 1*b* of the fan 1 correspond to inlets of air sucked into the fan 1. The motor body portion 6*a* is inserted into the fan 1 from the side of the opening portion 1*b* not so as to interference with the boss plate 4.

Figure 2:
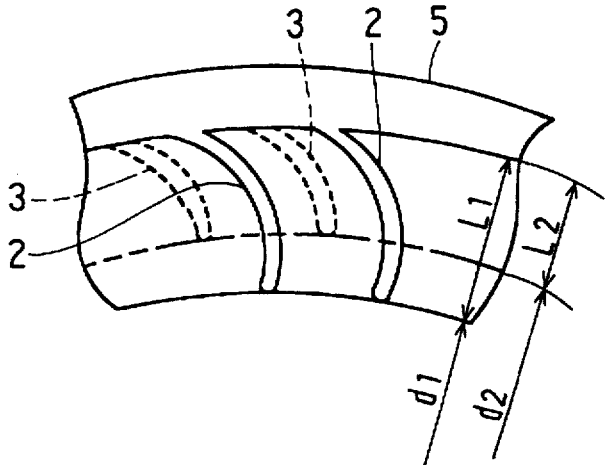
FIG. 2 is a perspective view taken from arrow A of FIG. 1.

Further, the outer diameter "D" of the fan 1 is equal throughout the entire length in the axial direction. On the other hand, the inner diameter $d_2$ of the insertion side is greater than the inner diameter $d_1$ of the non-insertion side. The inner diameters $d_1$ and $d_2$ of the non-insertion side and the insertion side are respectively uniform from the both end portions 1*c* and 1*d* to the boss plate 4. As shown in FIG. 2, the vane length $L_2$ [$L_2=(D-d_2)/2$] of the insertion side is smaller than the vane length $L_1$ [$L_1=(D-d_1)/2$] of the non-insertion side. Further, the vane 2 of the non-insertion side and the vane 3 of the insertion side are shifted from each other in the rotational direction of the fan 1 not to overlap with each other when viewed from the axial direction.

As shown in FIG. 1, a fan height $H_{fs}$ of the insertion side from the end portion 1*c* in the axial direction at the insertion side to the boss plate 4 is smaller than a fan height $H_{fm}$ of the non-insertion side from the end portion 1*d* in the axial direction at the non-insertion side to the boss plate 4. The ratio ($H_{fs}/H_{fm}$) of the fan height $H_{fs}$ of the insertion side to the fan height $H_{fm}$ of the non-insertion side $H_{fm}$ is approximately equal to a ratio [$(d_2^2-D_M^2)/d_1^2$] of a difference ($d_2^2-D_M^2$) between the square of the inner diameter $d_2$ at the insertion side and the square of an outer diameter $D_M$ of the motor body portion 6*a* to the square of the inner diameter $d_1$ at the non-insertion side.

A casing 7 accommodates and holds the fan 1 and the drive motor 6 and forms a passage of air blown from fan 1. The casing 7 is formed spirally around the axis of the fan 1. Opening portions 7*a* and 7*b* for sucking air are formed at both end sides in the axial direction of the fan 1 on the casing 7, and an outlet (not shown) connecting an outlet in a passenger compartment (not shown) of the vehicle is formed at a winding end side of the spiral of the casing 7.

The characteristics of the first embodiment will be described.

According to the first embodiment, because the inner diameter $d_2$ of the insertion side is greater than the inner diameter $d_1$ of the non-insertion side, a dimension $L_s$ from the inside end portion of the vane 3 to the outer end portion of the motor body portion 6*a* becomes larger as compared with the conventional blower in which the outer diameter of the motor body portion 6*a* is equal to $D_M$ and the inner diameter of the fan 1 is equally constant throughout the entire length of the axial direction. Because the real area [$(d_2^2-D_M^2)\pi/4$] of the inner opening portion 1*b* of the insertion side becomes larger, the suction resistance becomes smaller and the volume of blown-air can be increased as compared with the conventional blower.

Further, because the outer diameter of the fan 1 is equally constant throughout the whole length of the axial direction of the fan 1 and the motor body portion 6*a* is inserted into the fan 1, the air volume can be increased while the outer size of the fan 1 is maintained to have the same degree with the conventional blower.

Figure 3:
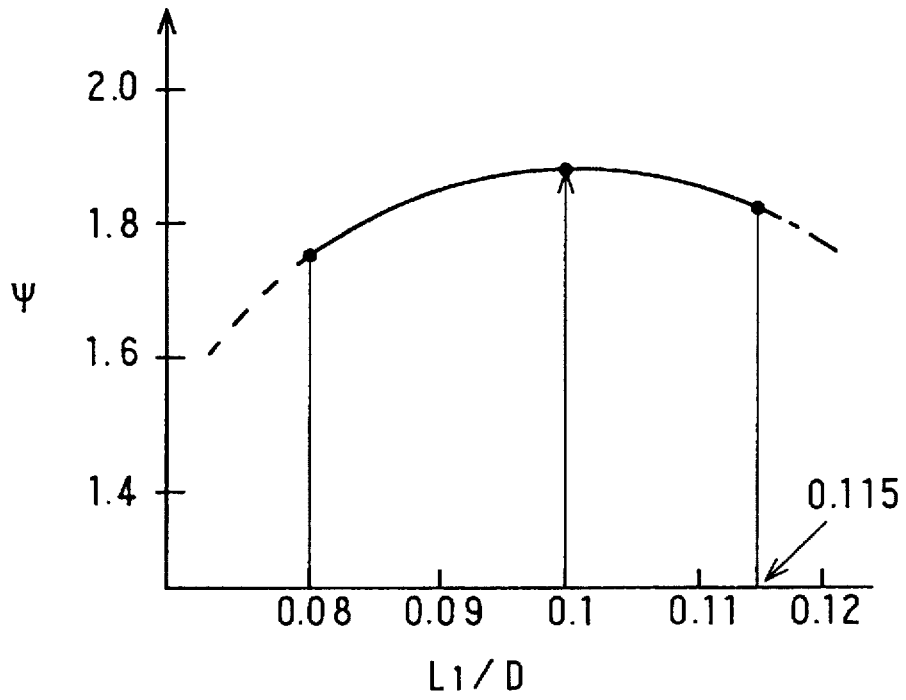
FIG. 3 is a graph showing a relationship between a pressure coefficient $\phi$ and a ratio of a vane length $L_1$ of non-motor insertion side to an outer diameter D of a fan 1.

Further, to increase the volume of the blown air, the inventors of the present invention studied and experimented the blower to optimize each dimension of the parts of the blower, and obtained the following result. That is, at the non-insertion side, a ratio of the half of the difference between the outer and inner diameters of the non-insertion side (i.e., the vane length $L_1$ of the non-insertion side) to the outer diameter D of the fan 1 is changed as a parameter and the pressure coefficient $\phi$ is measured. As shown in FIG. 3, the most suitable ratio ($L_1/D$) of the vane length $L_1$ to the outer diameter D of the fan 1 is in a range of 0.08–0.115.

Figure 4:
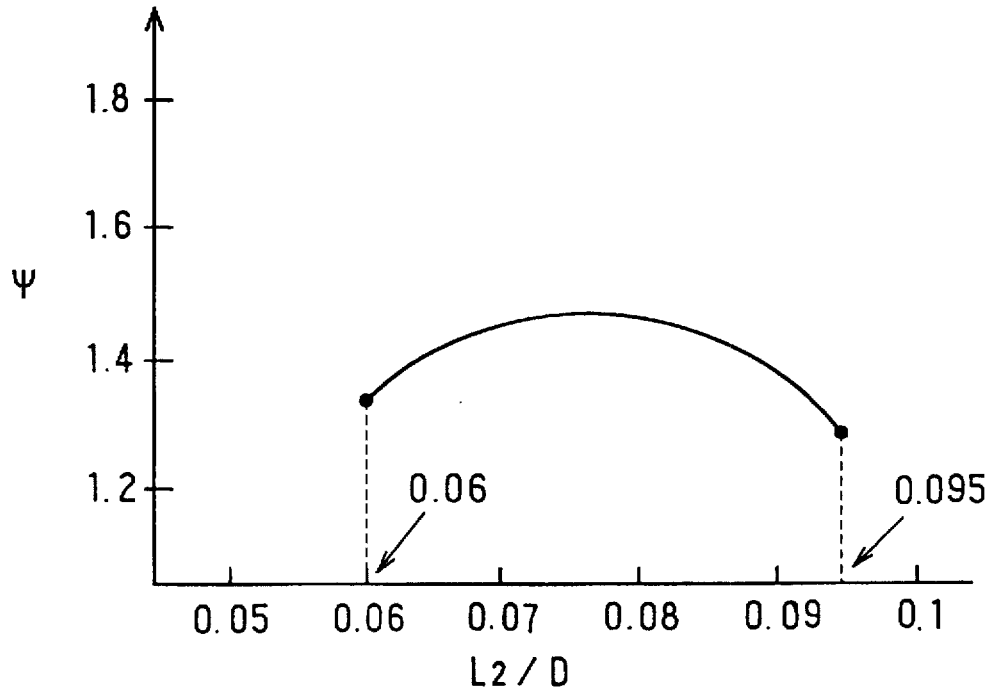
FIG. 4 is a graph showing a relationship between a pressure coefficient $\phi$ and a ratio of a vane length $L_2$ of motor insertion side to the outer diameter D of the fan 1.

Similarly, at the insertion side, a ratio of the half of the difference between the outer and inner diameters of the insertion side (i.e., the vane length $L_2$ of the insertion side) to the outer diameter D of the fan 1 is changed as a parameter and the pressure coefficient $\phi$ is measured. As shown in FIG. 4, the most suitable ratio ($L_2/D$) of the vane length $L_2$ to the outer diameter D of the fan 1 is in a range of 0.06–0.095. In the experiment of the insertion side, the ratio of the outer diameter $D_M$ of the motor body portion 6*a* is to the outer diameter D of the fan 1 is 0.875, i.e., $D_M=0.875\times D$.

Considering various variation factors and the kinds of the drive motor and the like are considered when the blower is actually mounted on a vehicle, it is preferable for the ratio ($L_2/L_1$) of the vane length $L_2$ to the vane length $L_1$ to be in a range of 0.6–0.95.

When the pressure coefficient $\phi$ is large, the pressure loss within the blower becomes small. Therefore, when the pressure coefficient $\phi$ increases, the volume of the blown air is increased.

Figure 5:
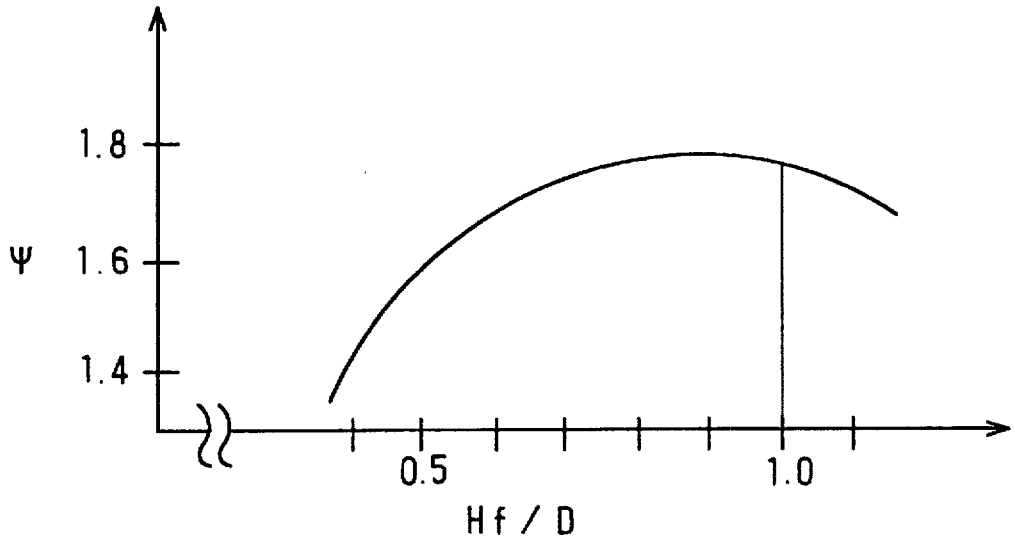
FIG. 5 is a graph showing a relationship between a pressure coefficient $\phi$ and a ratio of the fan height to the outer diameter D of the fan 1.

Next, the ratio ($D/H_f$) of the outer diameter D of the fan 1 to the fan height $H_f$ between the two end portions 1*d* and 1*c* of the rotation axial direction of the fan 1 is changed as a parameter and the pressure coefficient $\phi$ is measured. As shown in FIG. 5, it is preferable for the outer diameter D of the fan 1 and the fan height $H_f$ to be approximately equal to each other. The inventors confirm that the pressure coefficient $\phi$ does not depend on the ratio of the fan height $H_{fs}$ of the insertion side to the fan height $H_{fm}$ of the non-insertion side by the various experiments and studies.

Figure 6:
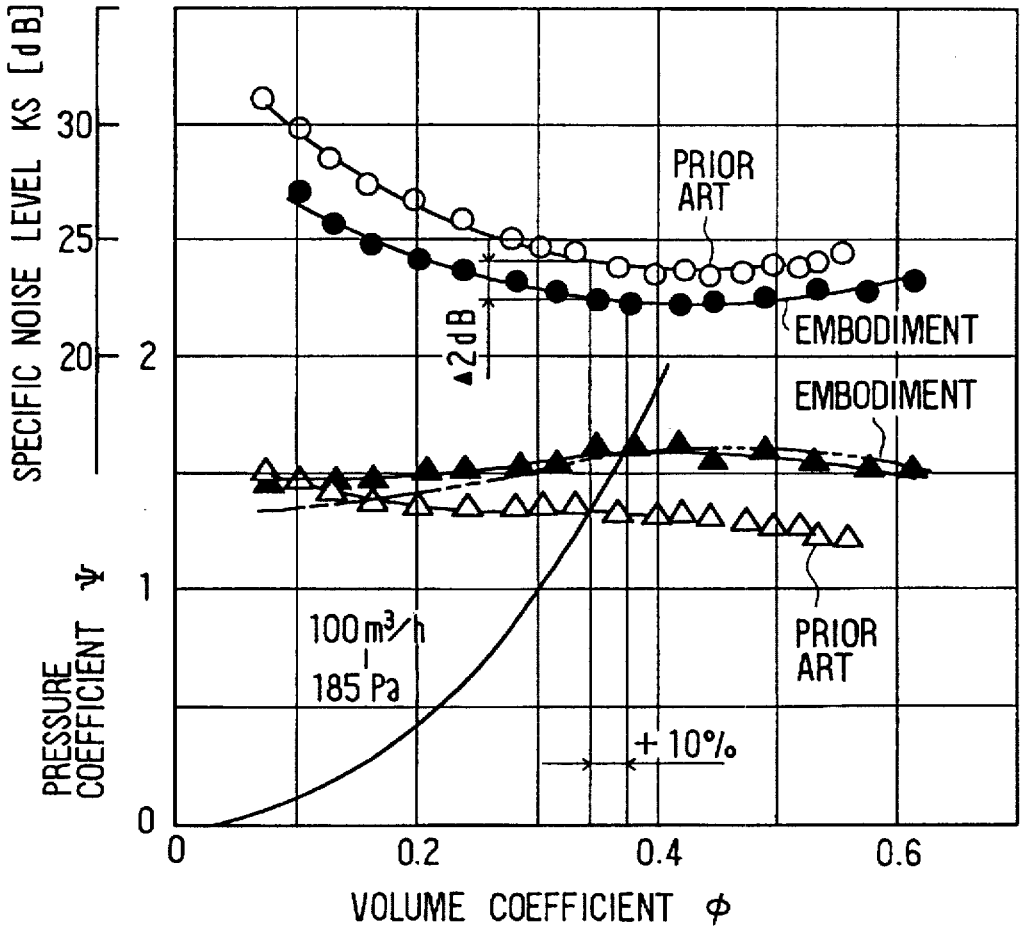
FIG. 6 is a graph showing fan characteristics of a centrifugal-type blower according to the first embodiment of the present invention and the conventional blower.

To confirm the above described results, the inventors have comparatively experimented the blower in which the ratio ($L_2/L_1$) of the vane length $L_2$ to the vane length $L_1$ is 0.95 and the ratio ($H_{fs}/H_{fm}$) of the fan height $H_{fs}$ of the insertion side to the fan height $H_{fm}$ of non-insertion side is 0.5 and the conventional blower in which the ratio of $L_2/L_1$ is 1.0 and the ratio of $H_{fs}/H_{fm}$ is 1.0. As shown in FIG. 6, when the air volume is 100 $m^3/h$ and the pressure is 185 Pa, the pressure coefficient $\phi$ and a specific noise level can be improved as compared with the conventional blower. The pressure coefficient $\phi$ improves by a maximum of about 10 percentages, and the specific noise level $K_s$ improves by a maximum of about 2 dB (decibel).

When the blower is actually installed in an air conditioning apparatus for a vehicle, a state having a large volume coefficient $\phi$ corresponds to an operating state having a small pressure loss such as a face mode in which air is blown toward the upper half of the body of a passenger in the passenger compartment, and a state having a small volume coefficient $\phi$ corresponds to an operating state having a large pressure loss such as a foot mode in which air is blown toward the foot area of the passenger in the passenger compartment.

A second embodiment of the present invention will be described.

In the second embodiment, the suction area of air at the insertion side is further increased.

Figure 7:
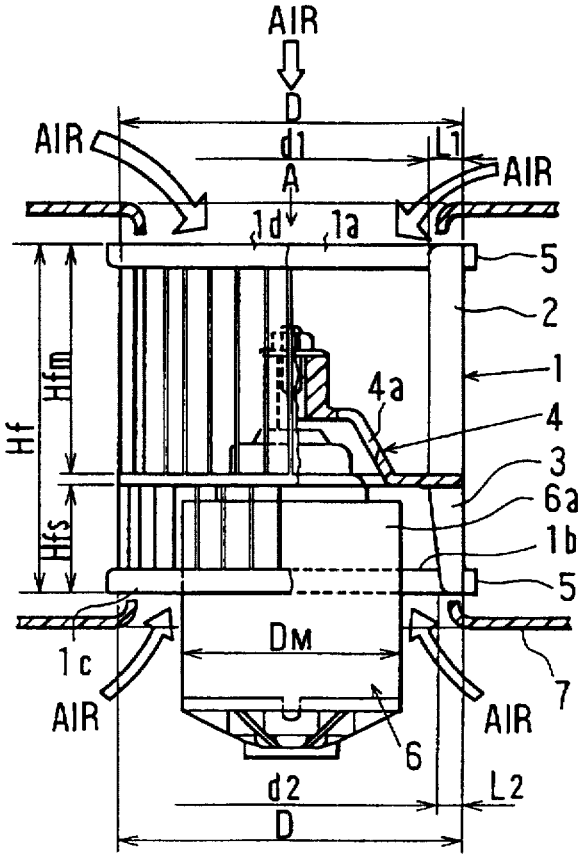
FIG. 7 is a cross-sectional view showing a centrifugal-type blower according to a second embodiment of the present invention.
Figure 8:
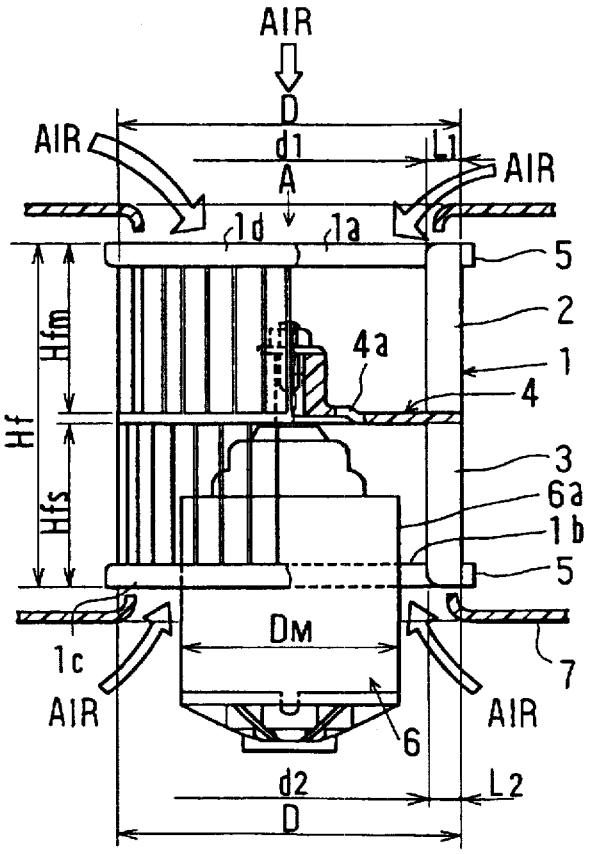
FIG. 8 PRIOR ART
FIG. 8 is a cross-sectional view showing the conventional centrifugal-type blower.

As shown in FIG. 7, the inner end portion of the vane 3 is inclined relative to the rotary axis of the fan 1 so that the inner diameter $d_2$ of the insertion side becomes larger from the boss plate 4 toward the end portion 1*c* at the insertion side in the rotation axial direction.

In the above-described embodiments, a plurality of holes 4*a* are formed on the boss plate 4. However, the holes 4*a* may be not formed thereon.

Further, in the above-described embodiments, the vane 2 of the non-insertion side and the vane 3 of the insertion side are shifted from each other in the rotational direction of the fan 1 not so as to overlap with each when viewed from the axial direction. However, even when the two vanes 2 and 3 may be overlapped with each other when viewed from the rotation axial direction, the present invention can be employed.

The present invention having been described hereinabove should not be limited to the disclosed embodiments but may be implemented in other ways without departing from the scope and spirit of the present invention.

What is claimed is:

1. A centrifugal-type blower comprising:

a centrifugal-type multiple-vane fan having a plurality of vanes formed circumferentially for sucking air from first and second open ends in an axial direction thereof and blowing air radially outwardly;

a motor having a motor body portion for driving said fan;

a boss plate disposed between said first and second ends of said fan for connecting said plurality of vanes and transmitting a driving force generated by said motor to said plurality of vanes; and a casing for accommodating said fan, wherein:

said motor body portion of said motor is inserted into said fan from said first end of said fan, said motor body portion being supported in said first end;

said fan has a uniform outer diameter (D) throughout an entire length thereof in the axial direction of said fan; and an inner diameter ($d_2$) of said fan between said boss plate and said first end is greater than an inner diameter ($d_1$) of said fan between said boss plate and said second end.

2. A centrifugal-type blower according to claim 1, wherein a ratio of difference between said outer diameter (D) and said inner diameter ($d_2$) of said fan at said first end to a difference between said outer diameter (D) and said inner diameter ($d_1$) of said fan at said second end is in a range of 0.6–0.95.

3. A centrifugal-type blower according to claim 1, wherein a fan height ($H_{fs}$) between said first end of said fan and said boss plate is smaller than a fan height ($H_{fm}$) between said second end of said fan and said boss plate.

4. A centrifugal-type blower according to claim 3, where a ratio of said fan height ($H_{fs}$) between said first end and said boss plate to said fan height ($H_{fm}$)between said second end and said boss plate is approximately equal to a ratio of a difference between the square of said inner diameter ($d_2$) of said first end and the square of an outer diameter ($D_M$) of said motor body portion to the square of said inner diameter ($d_1$) of said second end.

5. A centrifugal-type blower according to claim 1, wherein, said vane at said second end has a length ($L_1$), and said outer diameter (D) of said fan and said length ($L_1$) of said vane satisfy the following relationship:

$$L_1/D=0.08–0.115.$$

6. A centrifugal-type blower according to claim 5, wherein, said vane at said first end (1*c*) has a length ($L_2$), and said length ($L_1$) of said vane and said length ($L_2$) of said vane satisfy the following relationship:

$$L_2/L_1=0.6–0.95$$

7. A centrifugal-type blower according to claim 1, wherein said vane at said first end and said vane at said second end are shifted from each other in a rotational direction of said fan such that they are not in alignment with each other in the axial direction of said fan.

8. A centrifugal-type blower according to claim 1, wherein inner end portions of said vanes between said first end and said boss plate are inclined relative to an axis of said fan such that said inner diameter ($d_2$) at said first end increases gradually toward the end.

9. A centrifugal-type blower comprising:

a centrifugal-type multiple-vane fan having a plurality of vanes formed circumferentially for sucking air from said first and second open ends in an axial direction thereof and blowing air radially outwardly;

a boss plate disposed between said first and second ends of said fan to separate said plurality of vanes into a first group at said first end and a second group at said second end;

a motor having a motor body portion for driving said fan, said motor body portion being inserted and supported in said first group of vanes; wherein:

said first group and second group of vanes have uniform outer diameters (D) throughout an entire length thereof in the axial direction of said fan; and an inner diameter ($d_2$) of said first group of vanes is greater than an inner diameter ($d_1$) of said second group of vanes.

* * * * *

UNITED STATES PATENT AND TRADEMARK OFFICE

CERTIFICATE OF CORRECTION

PATENT NO. : 5,746,577

DATED : May 5, 1998

INVENTOR(S) : Koji Ito et al

It is certified that error appears in the above-identified patent and that said Letters Patent is hereby corrected as shown below:

Col. 2, line 45, delete "$\phi$" and substitute -- $\psi$ --

Col. 2, line 48, delete "$\phi$" and substitute -- $\psi$ --

Col. 2, line 51, delete "$\phi$" and substitute -- $\psi$ --

Col. 3, line 3, after the 2nd occurrence of "to" insert --the--

Col. 3, line 28, delete "interference" and substitute --interfere-- therefor

Col. 4, line 25, delete "$\phi$" and substitute -- $\psi$ --

Col. 4, line 32, delete "$\phi$" and substitute -- $\psi$ --

Col. 4, line 43, delete "$\phi$" and substitute -- $\psi$ --

Col. 4, line 45, delete "$\phi$" and substitute -- $\psi$ --

Col. 4, line 50, delete "$\phi$" and substitute -- $\psi$ --

Col. 4, line 54, delete "$\phi$" and substitute -- $\psi$ --

Col. 4, line 65, delete "$\phi$" and substitute -- $\psi$ --

Col. 5, line 1, delete "$\phi$" and substitute -- $\psi$ --

Col. 5, line 29, after "each" insert --other--

Signed and Sealed this

Tenth Day of November 1998

*Attest:*

Bruce Lehman

BRUCE LEHMAN

*Attesting Officer*

*Commissioner of Patents and Trademarks*